US008587397B2

(12) United States Patent
Hasel

(10) Patent No.: US 8,587,397 B2
(45) Date of Patent: Nov. 19, 2013

(54) SOLENOID WITH A CONNECTION REGION

(75) Inventor: Claus-Peter Hasel, Memmingen (DE)

(73) Assignee: SVM Schultz Verwaltungs-GmbH & Co., Memmingen (DE)

( * ) Notice: Subject to any disclaimer, the term of this patent is extended or adjusted under 35 U.S.C. 154(b) by 0 days.

(21) Appl. No.: 13/330,221

(22) Filed: Dec. 19, 2011

(65) Prior Publication Data

US 2012/0154078 A1 Jun. 21, 2012

(30) Foreign Application Priority Data

Dec. 20, 2010 (DE) ..... 10 2010 055 212

(51) Int. Cl.
*H01F 7/10* (2006.01)
*H01F 7/00* (2006.01)

(52) U.S. Cl.
USPC ..... 335/278; 335/250

(58) Field of Classification Search
USPC ..... 335/78, 250, 277, 278, 126
See application file for complete search history.

(56) References Cited

U.S. PATENT DOCUMENTS 3,909,758 A * 9/1975 Hans et al. ..... 335/255
4,272,748 A * 6/1981 Fugate et al. ..... 335/271
4,413,244 A * 11/1983 Hafner ..... 335/250
RE31,813 E * 1/1985 Fugate et al. ..... 335/271
5,423,117 A * 6/1995 Okada et al. ..... 29/605
5,481,237 A * 1/1996 Sarfati et al. ..... 335/278
5,663,699 A * 9/1997 Shiroyama ..... 335/126
5,703,551 A * 12/1997 Lefebvre et al. ..... 335/126
5,874,875 A * 2/1999 Kobayashi et al. ..... 335/128
5,986,530 A * 11/1999 Nippert et al. ..... 335/289
6,121,865 A * 9/2000 Dust et al. ..... 336/96
6,784,778 B2 * 8/2004 Stitz et al. ..... 336/90
7,004,450 B2 * 2/2006 Yoshimura et al. ..... 251/129.15
7,151,427 B2 * 12/2006 Muller et al. ..... 335/278
7,471,177 B2 * 12/2008 Jacobus ..... 335/282
7,545,248 B2 * 6/2009 Imanishi et al. ..... 335/202
7,549,899 B2 * 6/2009 Imanishi et al. ..... 439/877
7,570,138 B2 * 8/2009 Hirabayashi ..... 335/131
7,760,056 B2 * 7/2010 Utsunomiya et al. ..... 335/126
7,768,368 B2 * 8/2010 Muffler et al. ..... 335/278
8,212,637 B2 * 7/2012 Kurasawa ..... 335/126
2004/0104795 A1 * 6/2004 Stitz et al. ..... 336/65

* cited by examiner

*Primary Examiner* — Alexander Talpalatski

(74) *Attorney, Agent, or Firm* — Loginov & Associates, PLLC; William A. Loginov

(57) ABSTRACT

The invention refers to a solenoid, comprising a coil and a connection region for a current source. At least one conducting pin is arranged at the connection region. The pin is connected by a welding joint with the coil connector. The coil connector is connected to the coil. The pin can be positioned by a positioning piece slid on the pin.

19 Claims, 1 Drawing Sheet

SOLENOID WITH A CONNECTION REGION

FIELD OF THE INVENTION

Figure 1C:
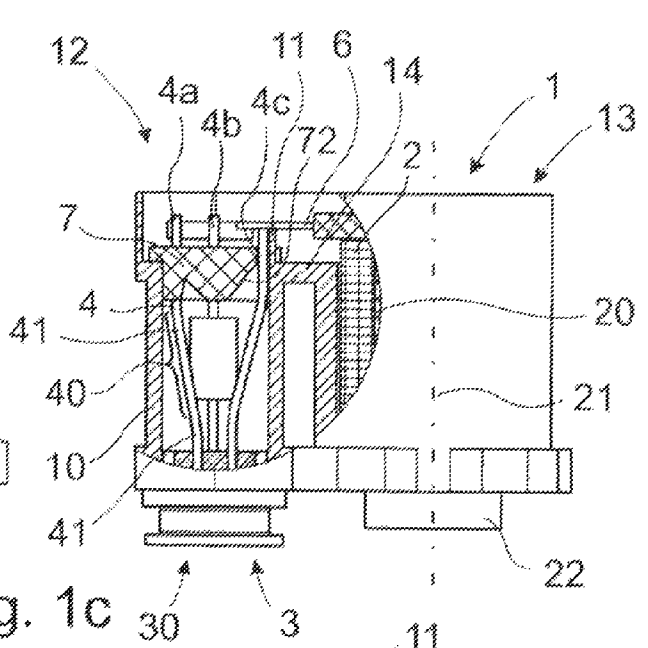

The invention refers to a solenoid comprising a coil that generates a magnetic field when flown through by electric current, and a connection region for a current source, wherein at least one conducting pin is arranged in the connection region.

BACKGROUND OF THE INVENTION

The invention refers to a solenoid comprising a coil that generates a Solenoids of this type are employed, for example, for operating valves or the like. The connection region is here formed, for example, by a plug-in contact. It is known in the state of the art to produce a connection between the coil and the connection region or the plug-in contact by strands. The strands or small wires are here soldered on the pin arranged at the connection region, and in the same way connected with a solder joint with the wire wound on the coil. Thus the coil comprises a coil body carrying a multitude of wire windings.

The electric contact is produced here in built-in condition. This means, that the single components are built in a casing of the solenoid. Producing the electric connection, for example by a solder joint, is rather laborious and therefore expensive. When using a strand connection between the connection region or the plug and the coil it is convenient, that this connection is rather resistant against vibrations, that means it is quite reliable when the solenoid of this type is built in, for example, in arrangements that oscillate or vibrate.

BRIEF SUMMARY OF THE INVENTION

It is an object of the invention to provide a solenoid, as described in the beginning, that, on the one hand, can be produced economically, however, on the other hand, is also reliable during operation.

In order to solve this problem, the invention refers to a solenoid, as described in the beginning, and suggests that the pin is in connection by a welded joint with an essentially rigid coil connector, and the coil connector is connected with the coil, and the pin at its end opposing the connection region can be positioned by a positioning piece that can be slid on the pin.

The invention suggests several individual measures synergistically supporting each other:

It is already known to employ a coil connector at the coil that is joined, for example, by a solder joint to the strand coming from the plug. According to the invention it is now suggested to connect the coil connector with the pin, that already exists at the plug-in contact, plug or connection region (these words can be exchanged in the frame of this application), by a welded connection. The welded connection is carried out, for example by means of resistance welding or as spot-welding, and is automated with a high precision and quality, and can therefore be carried out very economically.

The use of a guiding piece that can be slid on the pin has the advantage of a simple and reliable assembly of the solenoid according to the invention. The guiding piece serves here for unambiguously and reliably positioning the pin/pins (often the plug-in contact or connection region comprises several poles and therefore pins) and also holding them in the correct position during connecting, which is during welding. The guiding piece serves for carrying out a reliable welding joint.

Usually, a plug-in connection forms the connection region. The plug-in connection or the plug-in contact is carried out, for example, by a fitting junction of two interacting elements, for example the pin and the sleeve receiving the pin, outside the casing plane. In the frame of the invention, the word "pin" refers to any connecting element serving for conducting current, and is not restricted to a configuration extending longitudinally. Thus, for example, the pin in the plug-in contact can also be configured as a sleeve. It is skillful to lengthen the pin in the connection region, if necessary, and thus it becomes a conducting element substituting the otherwise known strand. According to the invention, welding is a very stable and fast connection technique that can be carried out very economically, for example, partly or fully automated, substitutes the laborious soldering process. Thus, the word "pin" comprises, according to the invention, a sleeve or a pipe as well.

The coil connector is sufficiently rigid or stiff to remain in the desired position during the assembly process and even after subsequent welding.

The guiding piece is slid on at least one pin in an appropriate way. Because of the traction between the guiding piece and the at least one pin, the force between the pin and the guiding piece are coupled, such that the pin can be positioned by the guiding piece in an appropriate way. The guiding piece is here, for example, orientated and/or arranged in a suitable way in the solenoid.

In an illustrative embodiment of the invention it is provided that the connection region, that is, in particular, the plug-in contact, is arranged in a casing of the solenoid, and the guiding piece is supported on the casing. Here, a casing surrounds the solenoid. The connection region, forming, for example, the plug-in contact, is arranged in the casing. If necessary, the casing is separated into several interconnected partial casings, and, according to the invention, configured in such a way that the guiding piece is supported on the casing. The support is configured at least force-fit, if not even form-fit, so that positioning of the at least one pin by the guiding piece is supported.

An illustrative embodiment of the invention provides for the guiding piece stabilizing the at least one pin against vibrations. The guiding piece does not only contribute considerably to an economic and reliable production of the solenoid according to the invention, but also defines in a suitable way the pin at its end opposite of the connection region (plug-in region). This additional supporting function, provided by the guiding piece, additionally stabilizes the entire arrangement against vibrations, and in particular does not further stress the welding joint. This configuration increases the reliability of the entire solenoid according to the invention.

An illustrative embodiment desirably provides that the guiding piece has at least one opening and/or one recess for receiving the at least one pin, and the opening or recess has a slope, and the pin has in an angulation region one or more angulations. For sliding the guiding piece on the at least one pin, one or more openings or recesses is/are provided at the guiding piece. According to the invention, it is provided here, that the opening or the recess has one or more slope/s. This slope covers a desirably acute angle with the longitudinal extension of the pin. The consequence is, that during a sliding motion of the guiding piece on the pin, the pin is angled like a connecting link, so that one or more angulations occur in one angulation region at the pin.

It has to be taken into consideration here, that the invention is not restricted with regard to the number of the recesses and openings referring to the number of pins at the connection region or plugs. Thus, it is possible, that not only one but several pin/s penetrate/s an opening or the recess/es. The guiding piece does not only effect here the angulation, which is connection link-like, but defines the ends of the pin or pins with respect to a rotational motion (rotational with reference to a rotational axis extending parallel to the longitudinally extending, non-angled pins). This also makes the positioning of the pin just for welding with the coil connector easier.

Furthermore, it is provided according to the invention that the slid-on guiding piece pushes the pin towards the in particular electrically conducting casing. This enables grounding of the casing by a pin of the connection region/plug-in contact provided therefore in an easy way. Additionally, of course, it is possible to weld the pin pushed already to the casing to the casing or a particular projection serving for that in a modification according to the invention.

A rotational definition of the guiding piece or the pin/s, as already described above, is carried out in a modification according to the invention by a positioning arrangement between the guiding piece and the casing. The positioning arrangement can be realized here, for example, by the positive interlocking of a nose and a recess, each of which being arranged at the guiding piece or the casing. The positioning arrangement, however, can be realised in another way, for example, by a suitable design of the external shape of the guiding piece and of the cross section of the casing, the guiding piece has to be inserted in!

A modification according to the invention provides that the pin/s is/are longer than half, in particular longer than 70% of the length of the coil. The length of the pin is here at least the length of the pin in the casing. Usually, the pin in the plug penetrates the plane of the casing, and is guided to the outside for forming the plug-in contact. In this feature the invention comprises both solutions, that means, the entire effective length of the pin inside and outside the casing, as well as the modification where the length refers only to the length of the pin extending in the casing. The advantage of this feature is the arrangement of the connection functions, which is the connection region or plug-in contact, on one side of the solenoid according to the invention. This arrangement can be carried out, for example, on the front side where also the armature operates a corresponding element, and wherein the connection between that pin and the coil is carried out on the back side, that is the other end of the coil. Therefore the pin extends desirably parallel to the longitudinal axis of the coil, in particular from the front side of the solenoid, formed by the connection elements (armature opening and plug-in contact), up to its back side.

An illustrative embodiment of the invention provides for the guiding piece being configured as plastic part, in particular as injection molded plastic part. Thus, the guiding piece can thus be manufactured economically in large quantity.

As explained earlier, the pin has, in a modification, a region extending in the casing, as well as a region that may be arranged outside the casing. In this part, the pin is part of a plug-in connection, wherein the word "pin" identically comprises a sleeve-like design (as it is common with plug-in contacts).

Advantageously, the coil connector is configured as punched part or as stamped bent part. The coil connector provides an electrically conducting connection between the wire of the coil and the pin, and thus eventually with the power supply, that is connected to the connection region or plug. The configuration of the coil connector as punched part or stamped bent part guarantees a very economic production. The coil body, on which the wire of the coil is wound, carries the coil connector, a clamping or gluing connection, for example, or the like provided for that.

Skillfully, the pins penetrating the casing in the plug are arranged, first of all, parallelly extending. Usually, a multitude of connections, and therefore also a multitude of pins, is provided in the connection region. As far as the invention is described with reference to a pin, the invention is not restricted to this, of course, this comprises in the same way also several pins, accordingly. The guiding piece here does not only have the function of effecting a suitable positioning of the pin/s, but it also achieves, as described, an appropriate angling of the pin/s in a suitable way, for example, to provide a protection grounding contact with the casing, or to achieve a suitable positioning of the pins among one another and with regard to the coil connector. It results therefrom, that at least one pin is angled once or several times. Of course, the invention also comprises a combination of non-angled and angled pins.

An illustrative embodiment of the invention provides that the coil connector has a length of more than 30% of the diameter of the coil. The coil connector is therefore clearly larger than the actual connection surface alone, and has also the function of conducting current. It is in particular provided here desirably, that the coil connector is longer than 50% of the diameter of the coil. In particular, a length of more than 60% of the diameter of the coil is illustratively desirable, in special applications even a length of the coil connector of more than 75% of the coil can be advantageous. Skillfully, the result is, that the coil connector extends at least with an acute angle, desirably rectangular to the coil axis, in particular along the coil axis.

Furthermore, the invention also comprises a method of manufacturing a solenoid. The problem is equally resolved by a method according to the invention, as well. According to the invention, it is suggested that a connection region with at least one pin extending in a casing is located in the casing, and, first of all, a guiding piece is slid on the pin, after that a coil with at least one coil connector configured essentially rigid is put in the casing, and, after that, the pin is welded with the coil connector. The arrangement is here chosen in such a way that the coil connector has a rather large length, such that it connects the spaced apart connection region with the coil. The sequence of steps is here consistent and advantageous, as the guiding piece cares for correct positioning of the pin or pins relative to the respective coil connectors. The mounted guiding piece here supports here the correct arrangement especially during the following welding, where the correct position is convenient for a fast welding, and thus unavoidable warming of this region is considerably reduced. Skillfully, the guiding piece is put in, such that positioning of the pin relative to the coil connector is carried out while the pin is "pre-electrified" relative to the coil connector, hence, an electric contact that will be stabilized by welding already exists.

During manufacturing of the plug with the pin/s, the pin/s are manufactured considerably lengthened. Skillfully, the pins are provided as straight elements, if necessary, other electronic components, such as, for example, resistors or diodes can be provided between them, if necessary. This depends on the respective schematic circuit diagram. For a perfect positioning of the pin relative to the coil connector, the pin obtains one or more angulations during sliding-on of the guiding pin.

In this connection it is in particular pointed out that all characteristics and features described with reference to the solenoid, but also methods, can be transferred accordingly also with reference to the formulation of the method according to the invention, and can be used according to the invention, and are thus considered as disclosed as well. The same applies vice versa, that means constructive, that is device, characteristics mentioned only with reference to the method can also be taken into consideration and be claimed in the frame of the device claims, that is the claims with reference to the solenoid according to the invention, and also count as part of the invention and disclosure.

BRIEF DESCRIPTION OF THE DIFFERENT VIEWS OF THE DRAWINGS

Figure 1B:
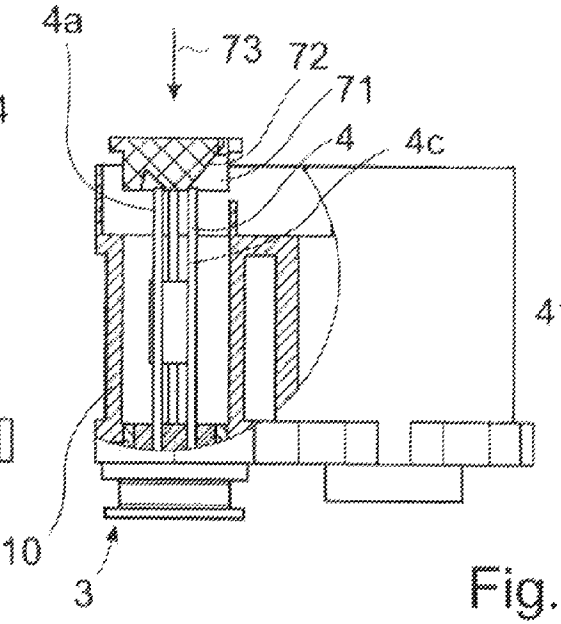
Figure 1A:
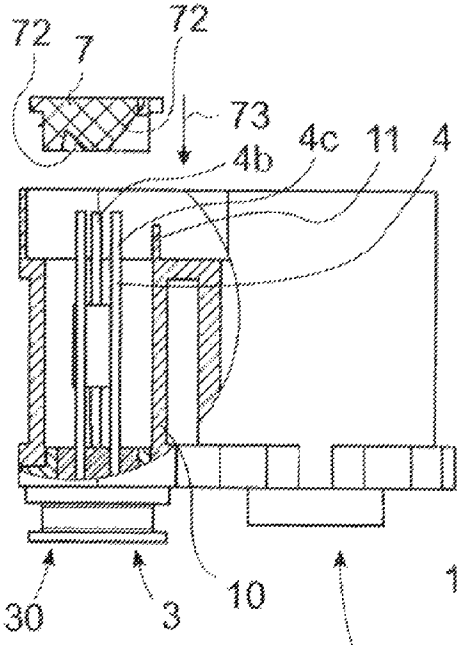
Figure 3:
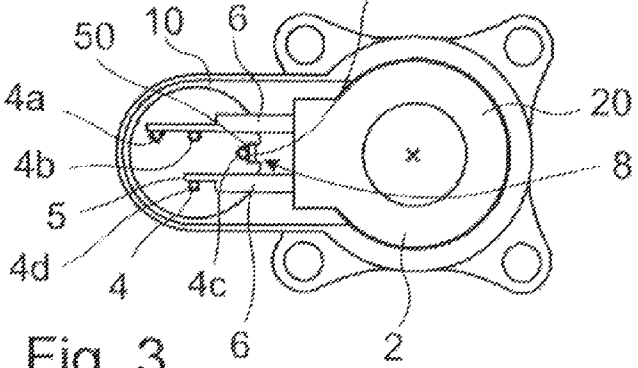
Figure 2:
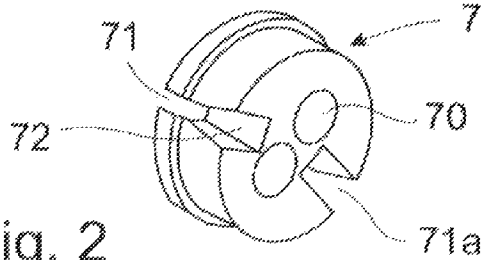

In the drawing the invention is shown schematically in particular in an example. In the figures:

FIGS. 1*a, b, c* each depicts in a side view the sequence of the invention method of manufacturing a solenoid according to the invention;

FIG. 2 depicts in a three-dimensional view the guiding piece according to the invention; and FIG. 3 depicts a top view of the inventive solenoid according to FIG. 1*c*.

In the figures identical or corresponding elements each are indicated by the same reference numbers, and therefore are, if not useful, not described anew.

DETAILED DESCRIPTION OF THE EMBODIMENTS

FIGS. 1*a, b, c* schematically show a solenoid 1 according to the invention.

The connection region 3 is formed by a plug-in contact 30, that is formed by several pins 4 that penetrate the plug from the outside towards the inside, which is into the casing 10. The pins 4*a, b, c, d* are arranged at the connection region 3. In the configuration of the solenoid 1 according to the invention as shown in FIGS. 1*a, b, c* the connection region 3 is arranged on the bottom, the pins 4 extend from the front (bottom) end of the casing 10 upwardly.

Pin 4*a* shows in the angulation region 40 two angulations 41 extending in opposite directions. Pin 4*c* is angled in opposite direction thereto.

These angulations are effected by the guiding piece 7 slid on the pins 4, 4*a*, 4*b*, 4*c*.

Above the guiding piece 7 the ends of the pins 4*a*, 4*b*, 4*c* project beyond it, and thus form a connection for the coil connectors 6 rectangular thereto, and which provide an electric connection from the pins 4 to the wire of the coil 2. The windings of the coil 2 are situated on a coil body 20.

The casing 10 used for the invention solenoid 1 is rather complex. It comprises two partial casings 12, 13, wherein the partial casing 12 houses the plug-in contact 30 with the pins 4, 4*a*, 4*b*, 4*c* that join them and extend within the partial casing 12. The partial casing 13 essentially receives the coil body 20 and the coil 2, respectively.

The partial casings 12, 13 are configured, for example, like cylinders, and connected to each other by a web 14 in the back. For assembling purposes the top region in FIG. 1*c* (actually the back region of the solenoid 1) is open. It can be sealed by a lid, which can be mounted pressure-proof (not shown).

The solenoid 1 is characterized in that within the coil 2 an armature housing (not shown) is provided with an armature being arranged thereto. If the wire winding of the coil 2 is electrified, the magnetic field generated moves the armature in the direction of the coil axis 21. An appropriate arrangement, the armature acts on, can be connected at the connection region 22. This may be, for example, a valve block or the like.

FIG. 1*c* shows the (almost) finished assembly situation of the solenoid 1 according to the invention. The back lid that has to be put on the coil or the coil connector 6 is still missing. FIGS. 1*a* and 1*b* show earlier steps of assembly of the solenoid 1 according to the invention. The assembly process of the solenoid 1, which is also part of the invention, starts in particular in FIG. 1*a*. The situation found here shows the plug-in contact 30 that is inserted in the left hand partial casing 12, wherein the pins 4, extending in the casing 10, essentially extend parallelly upwards, and the guiding piece 7 is not yet put on the pins 4, but is placed outside. The coil 2 is not yet put in. The guiding piece 7 is moved downward along arrow 73, and thus pushed on the pins 4. The start of this sliding-on motion can be gathered from FIG. 1*b*, wherein, for example, the right hand pin 4*c* in the recess 71 is in contact with the slope 72, so that the slope 72 bends the pin 4*c* out of its relatively centered position to the outside, as indicated in FIG. 1*c*. In general, the pins 4 are arranged rather tightly and space-saving in the plug-in contact 30. By an appropriate widening, in particular by the angulations 41 in the angulation region 40 the connection of the pins 4, for example, with the coil connector 6 or other components is made considerably easier. Because of the slopes 72 arranged at the guiding piece 7 the pins 4, 4*a*, 4*c* interacting in the slopes 72 are bent accordingly when the guiding piece 7, as shown in FIG. 1*b*, is pushed further on the pins 4, as it is shown by arrow 73 (that is parallel to the axis 21 of the coil).

The guiding piece 7 is slid on the pin until the upper ends emerge again from the guiding piece. This situation is shown in FIG. 1*c* and in top view in FIG. 3, respectively. By this arrangement the pin 4 or the pins 4*a*, 4*b*, 4*c* are positioned such that a welding joint 5 with the coil connector 6 (for the pins 4, 4*a*, 4*b*) can be provided in a simple way. The pin 4*c* is pushed against the casing 10 by the slope 72, and fixed at the projection 11 by a welding joint 50. Thus the casing 10 is grounded. The projection 11 is at the same time a part of the positioning arrangement 8 and extends positive interlocking in a groove or recess 71*a* of the guiding piece 7. This defines the rotational position of the guiding piece 7 relative to the pin/s 4, 4*a*, 4*b*, 4*c*, 4*d*. The coil connector 6 can well be gathered from FIG. 3 (in top view). The coil connector 6 is stably welded to the end regions of the pins 4*a*, 4*b*, 4*d* what makes for a simple, but economic and in particular reliable connection.

A welding joint 5 is provided for the connections between the pins 4, 4*a*, 4*b* and the coil connector 6.

In FIG. 2, the guiding piece 7 according to the invention is shown in detail in a three-dimensional view. The guiding piece 7 has the shape of a stopper, and is configured, for example, as plastic injection molded part. It has openings 70, like borings, that are arranged essentially in the middle or centered and penetrate the guiding piece in the slide-on direction, and has in the side region groove-like recesses 71, 71*a* that form a connecting link for guiding the pins 4 in their end or welding positions. The slopes 72 are orientated in such a way that they cover an acute angle with the pin 4 in the slide-on direction 73, when the guiding piece 7 has not yet been put on the pins.

Although the invention has been described by using exact examples that are explained in very detail, it is pointed out that this only serves for illustration purposes, and that the invention is not necessarily restricted to it, as alternative embodiments and methods will become clear for experts in view of the disclosure. Accordingly, changes are considered that can be carried out without deviating from the content of the described invention.

What is claimed is:

1. A solenoid comprising:

a coil that generates a magnetic field, and a connection region for a current source, at least one conducting pin constructed and arranged at the connection region, the pin is in connection with a substantially rigid coil connector through a welding joint, and the coil connector is connected with the coil, and the pin can be positioned at its end opposite the connection region by a separately disposed guiding piece that can be slid on the pin, wherein the connection region is arranged in a casing, with the guiding piece being supported at the casing, and wherein a positioning device is provided for the guiding piece and the casing is electrically conducting, the slid-on guiding piece pushes the pin to the electrically conducting casing.

2. The solenoid according to claim 1, wherein the guiding piece stabilizes the at least one pin against vibrations.

3. The solenoid according to claim 1, wherein the guiding piece has at least one opening and/or one recess for receiving the at least one pin, and the pin has an angulation region with the opening or the recess having a slope and the pin having one or more angulations in the angulation region.

4. The solenoid according to claim 1, wherein the guiding piece is configured as a plastic part, in particular as a plastic injection molding part.

5. The solenoid according to claim 1, wherein at the casing a projection is provided, and wherein at the projection a further welding joint with the pin is provided.

6. The solenoid according to claim 1, wherein a plug-in connection is provided, and the pin has an angulation region, and in the angulation region one or more angulations are provided, with the pin being longer than one half of the coil length.

7. The solenoid according to claim 6, wherein the pin is longer than 70% of the coil length.

8. The solenoid according to claim 1, wherein a plug-in connection is provided, the pin is part of the plug-in connection and/or within the connection region several pins, extending in the beginning parallel, being arranged penetrating the guiding piece, and having, at least partly, an angulation.

9. The solenoid according to claim 1, wherein within the connection region there are provided several pins, extending in the beginning parallel, being arranged penetrating the guiding piece, and having, at least partly, an angulation.

10. The solenoid according to claim 1, wherein the coil connector is configured as one of either a punched part or a stamped bent part.

11. The solenoid according to claim 1, wherein the coil connector has a length of more than 30% of the diameter of the coil.

12. The solenoid according to claim 11, wherein the coil connector has a length of more than 50% of the diameter of the coil.

13. The solenoid according to claim 12, wherein the coil connector has a length of more than 75% of the diameter of the coil.

14. The solenoid according to claim 1, wherein the coil connector extends one of either (a) at an acute angle to a coil axis and (b) rectangular to a coil axis.

15. A solenoid comprising:

a casing;

a coil disposed in the casing for generating a magnetic field;

a coil connector that is connected with the coil;

a connection region within the casing;

a contact at the connection region for supporting at least one conducting pin that has a base end and a free end extending into the connection region; and a guiding piece disposed separately of the casing for engagement with the free end of the at least one conducting pin and constructed and arranged to be slid onto the at least one conducting pin so as to cause the at least one conducting pin to bend and be re-positioned such that a welding joint between the at least one conducting pin and the coil connector can be provided.

16. The solenoid according to claim 15, wherein the guiding piece has at least one opening and/or one recess for receiving the at least one conducting pin.

17. The solenoid according to claim 15, wherein the contact includes a plug-in connection for supporting the base end of the at least one conducting pin, and the guide piece, upon sliding onto the at least one conducting pin, bends the at least one conducting pin outwardly.

18. The solenoid according to claim 15, including several conducting pins within the connection region, each supported from said contact, and arranged initially substantially in parallel, but being bent outwardly upon engagement by said guide piece.

19. The solenoid according to claim 18, wherein each conducting pin has along the length an angulation region, and the guiding piece has multiple openings and/or recesses for receiving the respective conducting pins.

* * * * *